US005451147A

United States Patent [19]

Sakagami et al.

[11] Patent Number: 5,451,147

[45] Date of Patent: Sep. 19, 1995

[54] TURBO VACUUM PUMP

[75] Inventors: Seiji Sakagami, Ibaraki; Shinjiro Ueda, Abiko; Masahiro Mase, Tochigi; Takashi Nagaoka, Tsukuba, all of Japan

[73] Assignee: Hitachi, Ltd., Tokyo, Japan

[21] Appl. No.: 767,666

[22] Filed: Sep. 30, 1991

[30] Foreign Application Priority Data

Sep. 28, 1990 [JP] Japan ..... 2-256925

[51] Int. Cl.[6] ..... F01D 1/36

[52] U.S. Cl. ..... 417/423.4; 415/90; 384/109

[58] Field of Search ..... 417/423.4; 415/90; 384/100, 107, 109

[56] References Cited

U.S. PATENT DOCUMENTS

| | | | |
|---|---|---|---|
| 3,753,623 | 8/1973 | Wutz | 415/90 |
| 3,832,084 | 8/1974 | Maurice | 384/109 |
| 3,947,193 | 3/1976 | Maurice | 415/90 |
| 3,969,042 | 7/1976 | Bachler | 384/109 |
| 4,180,370 | 12/1979 | Klatt et al. | 415/90 |
| 4,734,018 | 3/1988 | Taniyama et al. | 417/423.4 |
| 4,764,034 | 8/1988 | Fust et al. | 415/90 |
| 4,893,985 | 1/1990 | Holss | 415/90 |
| 4,929,151 | 5/1990 | Long et al. | 415/90 |

FOREIGN PATENT DOCUMENTS

| | | |
|---|---|---|
| 2253156 | 6/1975 | France . |
| 2632361 | 12/1989 | France . |
| 3932228 | 4/1990 | Germany . |

OTHER PUBLICATIONS

Patent Abstracts of Japan vol. 12, No. 315 (M-735) (3162) 826/88 and JP-A-63 085 288 (Hitachi) Apr. 15, 1988.

Patent Abstracts of Japan vol. 12, No. 137 (M-690) (2984) Apr. 26, 1988, and JP-A-62 258 186 (Hitachi) Nov. 10, 1987.

Patent Abstracts of Japan vol. 13, No. 477 (M-885) (3825) 27 Oct. 1989 and JP-A-1 187 396 (Hitachi) Jul. 26, 1989.

Patents Abstracts of Japan vol. 14, No. 155 (M-954) (4098) Mar. 26, 1990 and JP-A-2 016 389 (Ibiden) Jan. 19, 1990.

Japanese Patent Unexamined Publication No. 62-258186.

Japanese Patent Unexamined Publication No. 1-267392.

Japanese Patent Unexamined Publication No. 1-187396.

Patent Abstracts of Japan vol. 14, No. 29 (M-922) (3972) Jan. 19, 1990 and JP-A-1 267 392 (Hitachi) Oct. 25, 1989.

*Primary Examiner*—Richard A. Bertsch
*Assistant Examiner*—Peter Korytnyk
*Attorney, Agent, or Firm*—Antonelli, Terry, Stout & Kraus

[57] ABSTRACT

A compact, easy-to-handle turbo vacuum pump includes a housing having an inlet port and an outlet port; a cylindrical rotor disposed in the housing and having a stepped peripheral surface and a plurality of blades secured to protruding corners of the steps; and a pumping mechanism portion in which a pumping stage is formed by a stator which faces the blades of the rotor across a narrow gap, and in which peripheral pump flow paths are provided in step-like recessions inside the stator. The turbo vacuum pump further includes a rotating shaft which is connected to the rotor and is rotatably supported by a radial gas bearing and a thrust gas bearing; and a motor portion for operating the rotor. Gas sucked in through the inlet port can be discharged into the atmosphere through the outlet port.

7 Claims, 6 Drawing Sheets

TURBO VACUUM PUMP

BACKGROUND OF THE INVENTION

1. FIELD OF THE INVENTION

The present invention relates to a turbo vacuum pump such that pressure at an outlet port thereof equals to the atmospheric pressure. More particularly, it relates to a compact, easy-to-handle turbo vacuum pump.

2. DESCRIPTION OF THE PRIOR ART

Conventional turbo vacuum pumps are known, such as that disclosed in Japanese Patent Unexamined Publication No. 62-258186. This conventional turbo vacuum pump is equipped with a housing having an inlet port and an outlet port, the housing extending between the inlet port and the outlet port, a rotating shaft rotatably supported with the aid of a bearing in the housing, a centrifugal pump stage and a peripheral pump stage. The pump stages of the above two types are disposed one after another in the housing.

As disclosed in Japanese Patent Unexamined Publication No. 1-267392, it is possible to employ a type of turbo vacuum pump in which pressure in an outlet port thereof is made equal to the atmospheric pressure so as to discharge gas, and in which a magnetic bearing, requiring no lubricating oil, is used as the bearing of the pump.

In the turbo vacuum pump disclosed in Japanese Patent Unexamined Publication No. 1-187396, a centrifugal pump stage and a peripheral pump stage constitute a pumping mechanism portion, and a hydrodynamic type gas bearing supports a rotating shaft.

However, in the turbo vacuum pump disclosed in Japanese Patent Unexamined Publication No. 62-258186 mentioned above, an impeller, a stator plate, another impeller and another stator plate are alternately arranged in the axial direction of the pump. Both of these plates must be divided in half to insert them. Such a structure is complicated, and there is a limit to how small the structure can be made. The pump has a vertical axis structure in which lubricating oil is drawn in from an oil tank at the lower end of the pump so as to lubricate the bearing. Owing to this structure, the number of possible directions from which the pump can be installed is limited. Also, because of the use of an oil-lubricating ball bearing, the oil contaminates the inside of a passage in the pump during long-time use thereof, even though this contamination is negligible.

In the turbo vacuum pump disclosed in Japanese Patent Unexamined Publication No. 1-267392 mentioned above, no contamination caused by oil occurs since lubricating oil is not used. The magnetic bearing, however, requires a large number of very expensive parts, including a control unit. Because the pump has a complicated structure, it is difficult to reduce the size thereof.

SUMMARY OF THE INVENTION

The present invention provides a turbo vacuum pump comprising: a housing having an inlet port and an outlet port; a cylindrical rotor disposed in the housing and having a stepped peripheral surface and a plurality of blades secured to protruding corners of the steps; a pumping mechanism portion in which a pumping stage is formed by a stator which faces the blades of the rotor across a narrow gap, and in which peripheral pump flow paths are provided in step-like recessions inside the stator; a rotating shaft connected to the rotor and rotatably supported by a radial gas bearing and a thrust gas bearing; and a motor portion for operating the rotor; wherein gas sucked in through the inlet port can be discharged into the atmosphere through the outlet port.

This invention also provides a turbo vacuum pump comprising: a housing having an inlet port and an outlet port; a cylindrical rotor disposed in the housing and having a stepped peripheral surface and a plurality of blades secured to protruding corners of the steps; a pumping mechanism portion in which a pumping stage is formed by a stator which faces the blades of the rotor across a narrow gap, and in which peripheral pump flow paths are provided in step-like recessions inside the stator; a rotating shaft connected to the rotor and rotatably supported by a radial gas bearing and a grease-lubricating ball bearing; and a motor portion for operating the rotor; wherein gas drawn in through the inlet port can be discharged into the atmosphere through the outlet port.

DESCRIPTION OF THE PREFERRED EMBODIMENTS

Figure 1:
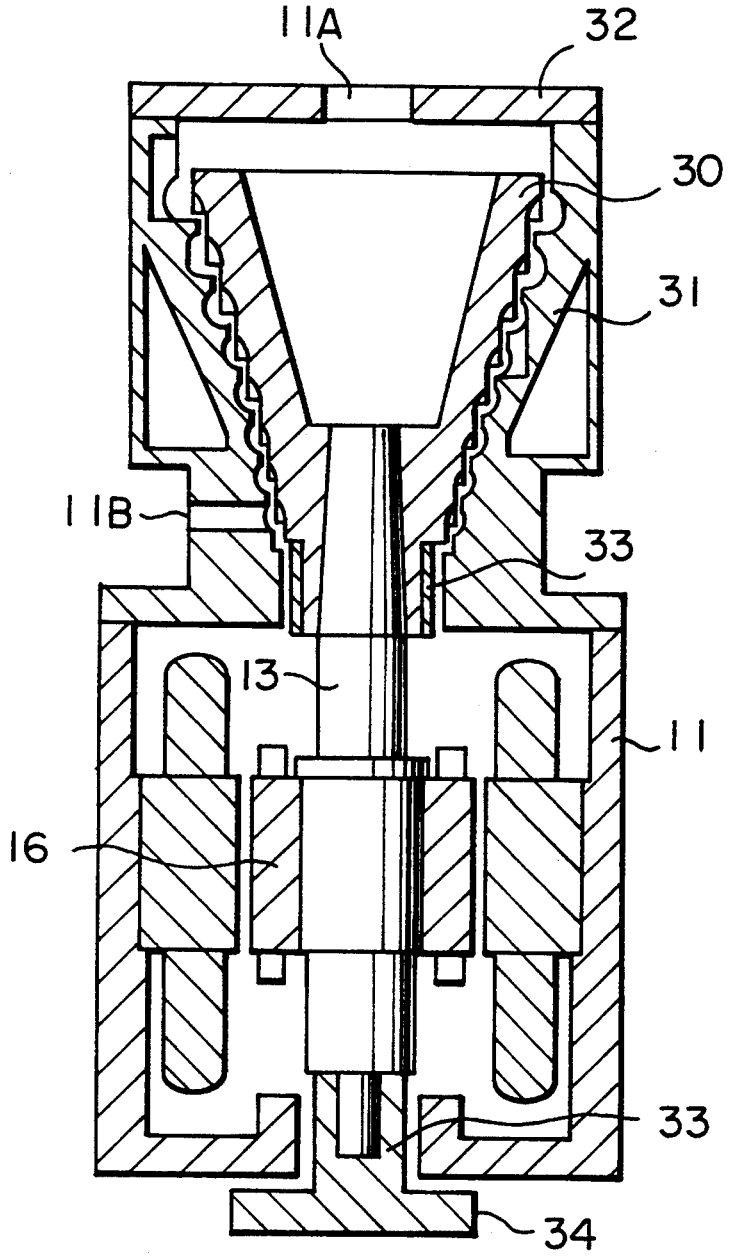
FIG. 1 is a vertical cross-sectional view showing an embodiment of a turbo vacuum pump according to the present invention.

FIG. 1 is a vertical cross-sectional view showing an embodiment of a turbo vacuum pump according to the present invention. The turbo vacuum pump is equipped with a pumping mechanism portion and an operating portion. The pumping mechanism portion is composed of a peripheral pump impeller 30, a stator 31 and a lid 32. The operating portion is composed of a rotating shaft 13 and a high-frequency motor 16 provided around the rotating shaft 13. The rotating shaft 13 is rotatably supported by a hydrodynamic type radial gas bearing 33 and a hydrodynamic type thrust gas bearing 34, both bearing being accommodated in a housing 11.

Figure 2A:
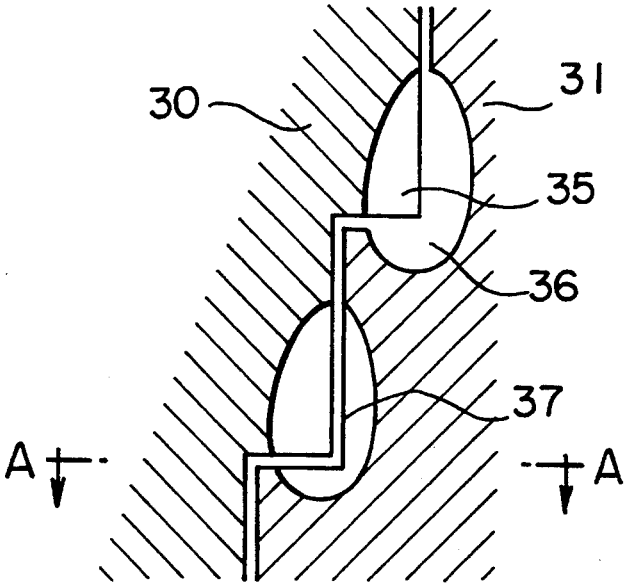
FIG. 2*a* is an enlarged vertical cross-sectional view showing a portion around the blades of a peripheral pump impeller illustrated in FIG. 1.
Figure 2B:
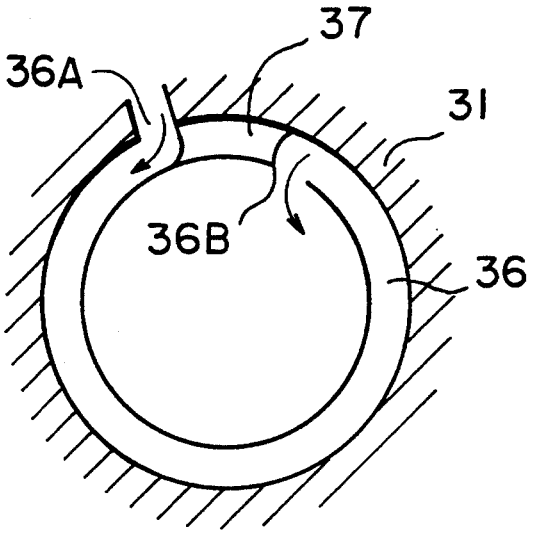
FIG. 2*b* is an enlarged horizontal cross-sectional view taken along line A—A of FIG. 2*a*.
Figure 3:
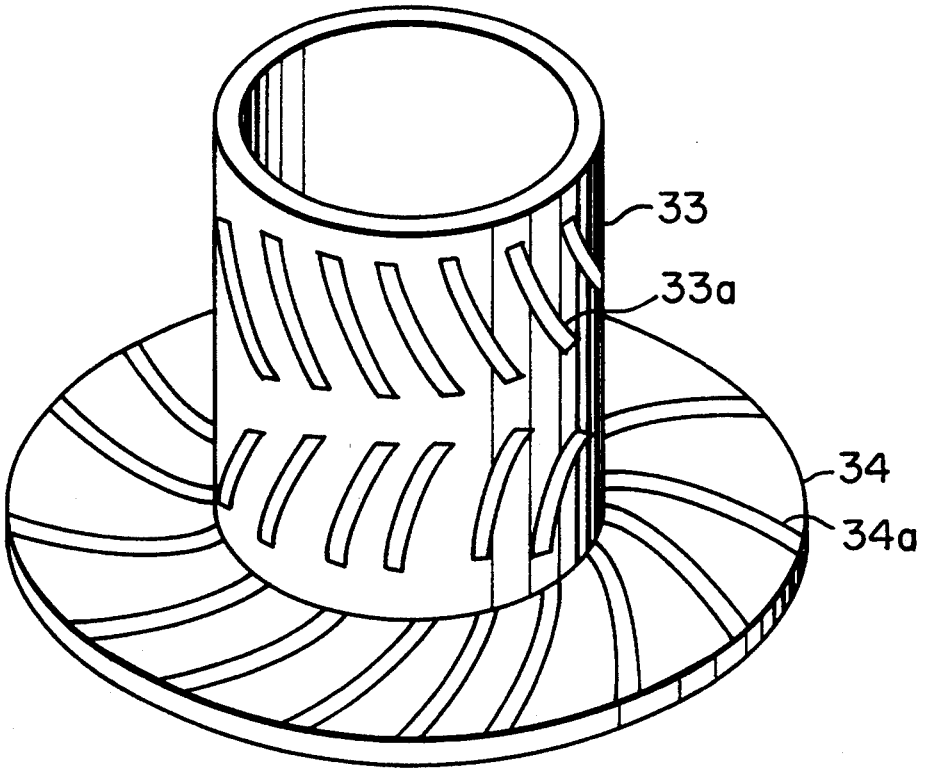
FIG. 3 is a view showing the outward appearance of a gas bearing.

The peripheral pump impeller 30 is shaped as a cylinder having steps. A plurality of blades 35 are secured to protruding corners of the steps. As shown in FIGS. 2*a* and 2*b*, the stator 31 faces the impeller 30 across a narrow gap therebetween. Around each corner, a partition 37 is provided in a portion of a circumferential direction of a gas passage 36 so as to surround the blades 35 of the impeller 30. An inhaling opening 36A is formed at the forward side of each partition 37, and a discharge opening 36B is formed at the rear side of each partition 37, where the peripheral pump impeller 30 rotates. The position of the inhaling opening 36A of a given stage deviates from that of another inhaling opening 36A of the next stage; likewise, the position of the discharge opening 36B of a given stage deviates from that of another discharge opening 36B of the next stage. The inhaling opening 36A of a given stage is connected in series to the discharge opening 36B of the preceding stage. In this way, because the peripheral pump impeller 30 faces the stator 31 at each stage, these components can be integrally formed with each other. As shown in FIG. 3, the hydrodynamic type radial gas bearing 33 has grooves 33*a* formed on the surface thereof; similarly, the hydrodynamic type thrust gas bearing 34 has grooves 34*a* formed on the surface thereof.

The operation of the above embodiment of this invention will now be described.

The hydrodynamic type radial gas bearing 33 supports, in a non-contact manner, the vibrations and load of the rotating shaft 13 in the radial direction of the shaft 13. The hydrodynamic type thrust gas bearing 34 supports the vibrations and load of the rotating shaft 13 in the thrust direction of the shaft 13. Because of the integral formation of the peripheral pump impeller 30 and the stator 31, it is possible to improve the accuracy with which these two components are machined. The use of the hydrodynamic type radial gas bearing 33 increases the diameter and hence the stiffness of the rotating shaft 13, thus resulting in an improvement in vibration characteristics. The high-frequency motor 16, integrally formed with the rotating shaft 13, is capable of operating the peripheral pump impeller 30 at a high speed.

Since the peripheral pump impeller 30 operates at a high speed, gas sucked in through an inlet port 11A flows into the gas passage 36 through the inhaling opening 36A of the first stage. When the gas flows to the blades 35 of the impeller 30, the blades 35 rotating at a high speed provide the gas with speed in the circumferential direction of the impeller 30. A centrifugal force discharges the gas between the blades 35 in the radial direction of the impeller 30. After the speed of the gas decreases at the gas passage 36 and pressure is recovered, the gas flows again between the blades 35 while forming a vortex. The gas undergoes the above procedure as many times as the number of stages while it is flowing through the gas passage 36 from the inhaling opening 36A to the discharge opening 36B of each stage. The gas flows helically through the gas passage 36 while fully gaining energy from the peripheral pump impeller 30. It is then discharged into the atmosphere through an outlet port 11B connected to the discharge opening 36B of the last stage.

As described above, the peripheral pump impeller 30 gains a high compression ratio in such a manner that it provides the gas with kinetic energy, which is converted into static pressure. Therefore, if it is possible to rotate the peripheral pump impeller 30 at a high speed, it is also possible to improve the performance of the pump. The shaft power of the turbo vacuum pump is proportional to the third power of the rotating speed and the fifth power of the diameter of the impeller. Thus when the peripheral pump impeller is made compact to rotate at a higher speed, the shaft power can be reduced without modifying the performance of the turbo vacuum pump; the size of the turbo vacuum pump can be reduced; and the high-frequency motor 16 having a smaller capacity can be employed. Since the hydrodynamic type radial gas bearing 33 and the hydrodynamic type thrust gas bearing 34 are used as bearings, lubricating oil is not required for the bearings, nor is a special sealing method for separating the mechanical portion from the operating portion of the pump. A vacuum equipment will not be contaminated because oil is not used. The pump can be installed on a vacuum equipment in any direction and is easy to handle.

Figure 4:
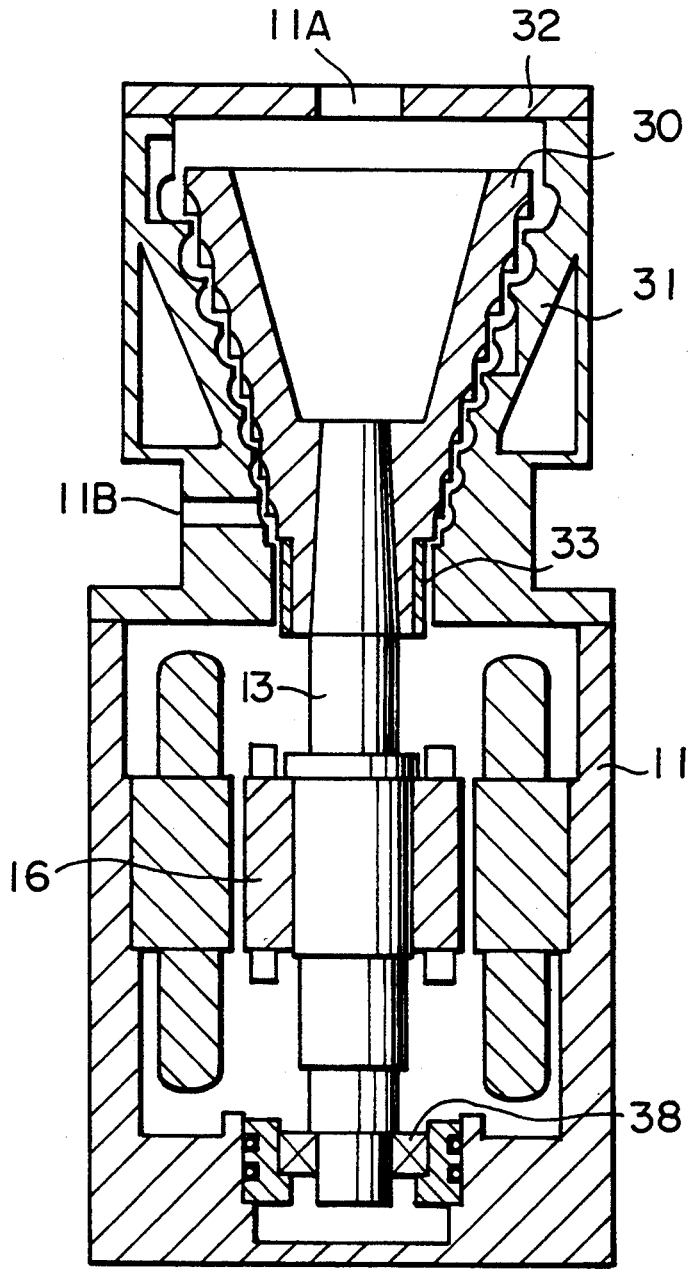
FIG. 4 is a vertical cross-sectional view showing another embodiment of a turbo vacuum pump according to this invention.

FIG. 4 is a vertical cross-sectional view showing another embodiment of the turbo vacuum pump according to this invention. In the drawing components which are identical to those in FIGS. 1, 2*a* and 2*b* are denoted by the same reference characters. The turbo vacuum pump is equipped with a pumping mechanism portion and an operating portion. The pumping mechanism portion is composed of a peripheral pump impeller 30, a stator 31 and a lid 32. The operating portion is composed of a rotating shaft 13 and a high-frequency motor 16 provided around the rotating shaft 13. The rotating shaft 13 is rotatably supported by a hydrodynamic type radial gas bearing 33 and a grease-lubricating ball bearing 38, both bearings being accommodated in a housing 11. The same advantageous effects as those described in the first embodiment are obtainable with the above arrangement.

A further embodiment of the turbo vacuum pump according to this invention will be described with reference to FIG. 5.

As shown in this drawing, this embodiment differs from the embodiment shown in FIG. 4 in that a spiral grooved pump stage 41 is provided in addition to a peripheral pump stage 40, composed of the peripheral pump impeller 30 and the stator 31, shown in FIG. 4. In the embodiment shown in FIG. 1, as described already, the peripheral pump stage provides gas with speed energy to convert it into pressure. A high compression ratio is thereby obtainable. Thus, the performance of the pump can increase in the pressure zone of a viscous flow, but decreases in the pressure zones of intermediate and molecular flows. The ultimate pressure of the vacuum pump is limited to a low vacuum zone.

Figure 5:
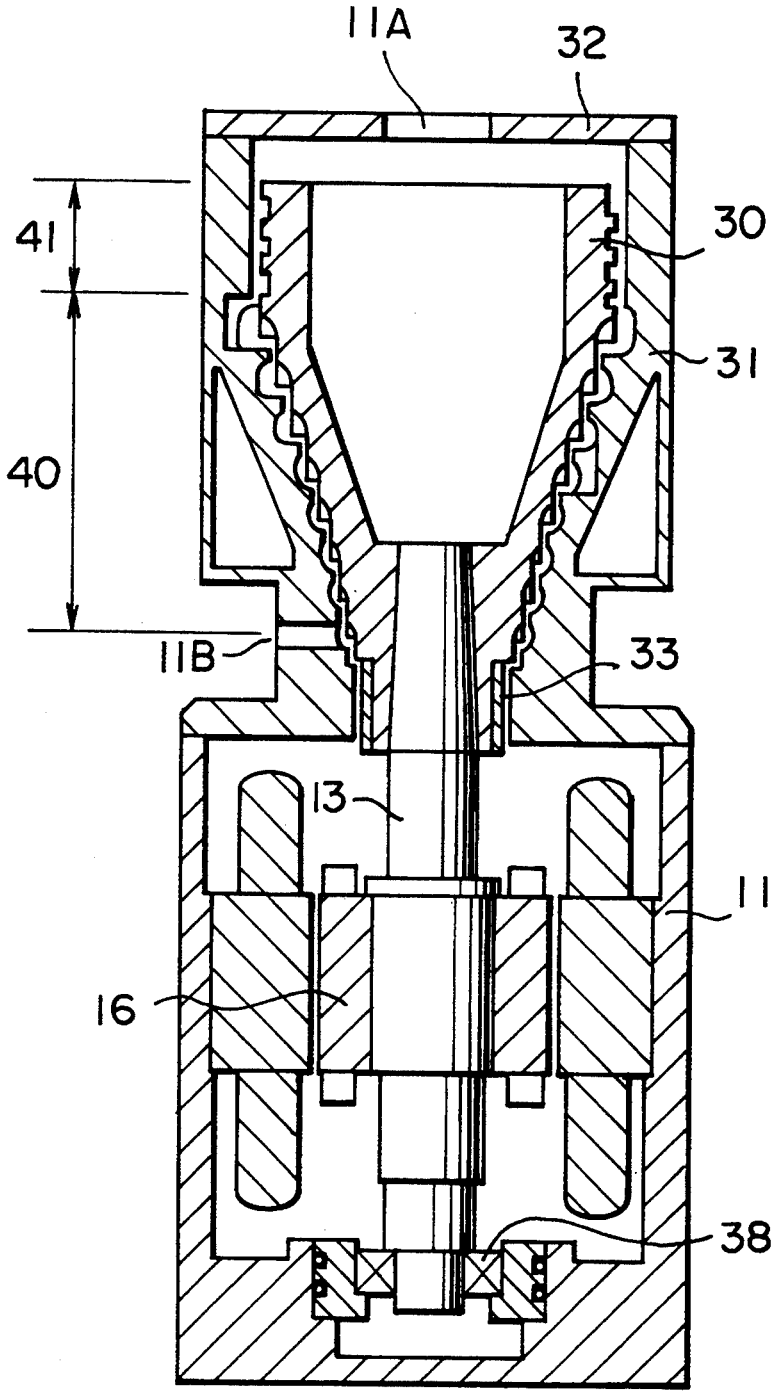
FIG. 5 is a vertical cross-sectional view showing a further embodiment of a turbo vacuum pump according to this invention.

In the embodiment shown in FIG. 5, to obtain the ultimate pressure even in the pressure zone of the molecular flow, the spiral grooves pump stage 41, which operates effectively with the intermediate and molecular flows, is installed on the low pressure side of the peripheral pump stage 40. A centrifugal pump stage, an axial pump stage or the like is used as a pump stage operating effectively with the intermediate and molecular flows. However, these stages must have a structure in which a stator is divided in half to insert it, so that it is difficult to maintain the accuracy with which the stages are machined. Thus the stages are not suitable for a smaller pump operating at a higher speed. In this embodiment, because of the peripheral pump stage 40 and the spiral grooved pump stage 41, the ultimate pressure of the turbo vacuum pump can be made higher.

Figure 6:
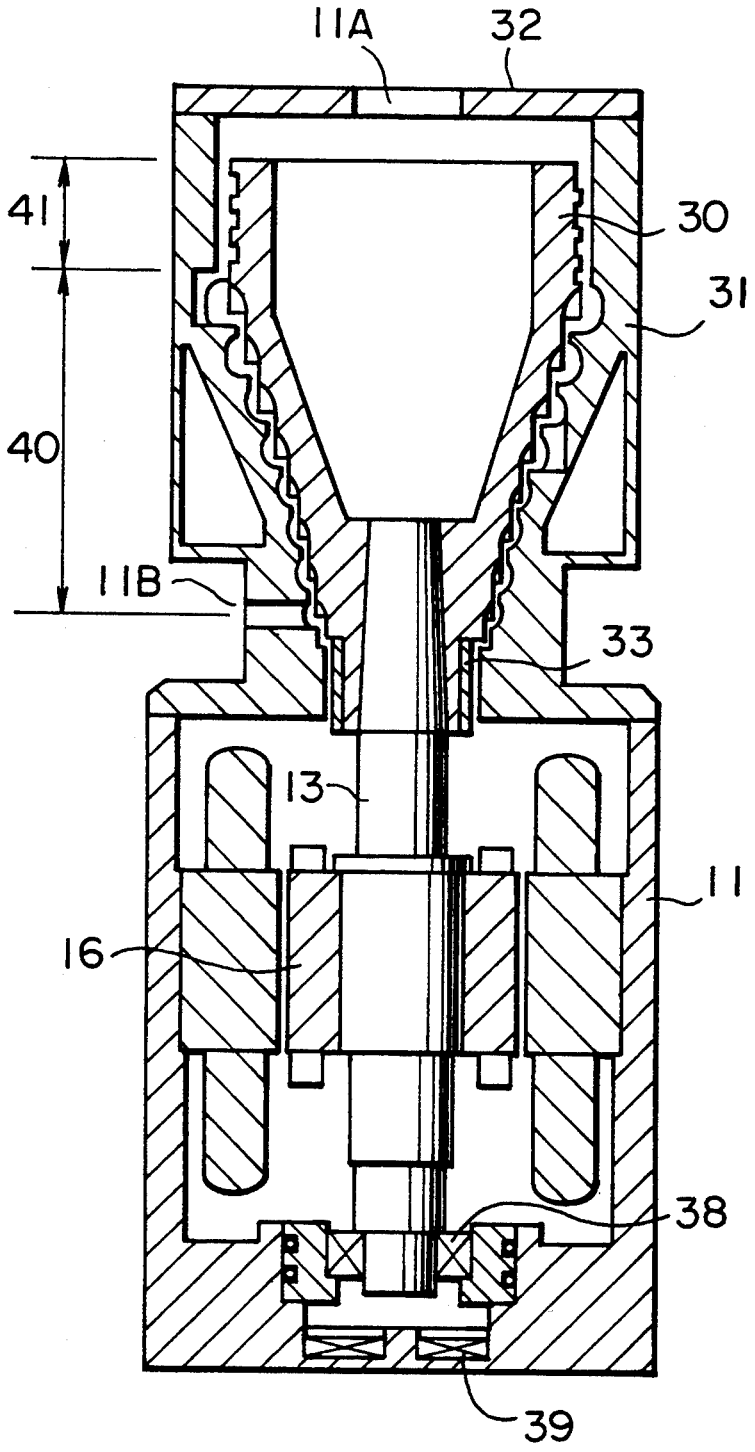
FIG. 6 is a vertical cross-sectional view showing a still further embodiment of a turbo vacuum pump according to this invention.

FIG. 6 shows a still further embodiment of this invention. In the drawing components which are identical to those in FIG. 4 are denoted by the same reference characters. In this embodiment a fan 39 is provided in a housing 11 in which a hydrodynamic type radial gas bearing 33 and a grease-lubricating ball bearing 38 are accommodated.

This embodiment can effectively remove the heat generated by a high-frequency motor 16 and the grease-lubricating ball bearing 38. It is thus possible to decrease the deterioration of the grease and to increase the life of the bearings.

What is claimed is:

1. A turbo vacuum pump comprising:

a housing having an inlet port and an outlet port;

a cylindrical rotor disposed in the housing and having a stepped peripheral surface and a plurality of blades secured to protruding corners of the stepped peripheral surface;

a pumping mechanism portion in which a pumping stage is formed by a stator facing the blades of said rotor across a narrow gap, and in which peripheral pump flow paths are provided in step-like recessions inside the stator;

a rotary shaft connected to said rotor and rotatably supported by a radial gas bearing capable of supporting loads of said shaft in a radial direction of said shaft and a grease-lubricating ball bearing capable of supporting loads of said shaft in a radial direction of said shaft and in a thrust direction of said shaft and a motor portion for operating said rotor, said motor portion being located along an axial length of said rotary shaft between said radial gas bearing and said grease-lubricating ball bearing with said radial gas bearing being located between said pumping mechanism portion of said pump and said motor portion;

wherein gas drawn in through the inlet port can be discharged into the atmosphere through the outlet port.

2. A turbo vacuum pump according to claim 1, wherein the radial gas bearing is a hydrodynamic type gas bearing.

3. A turbo vacuum pump according to claim 1, wherein a means for cooling air is provided in the motor portion.

4. A turbo vacuum pump according to claim 1, wherein a spiral grooved pump stage is disposed on the side of an inhaling opening of a peripheral pump stage.

5. A turbo vacuum pump comprising:

a housing having an inlet port and an outlet port;

a cylindrical rotor disposed in the housing and having a stepped peripheral surface and a plurality of blades secured to protruding corners of the stepped peripheral surface;

a pumping mechanism portion in which a pumping stage is formed by a stator facing the blades of said rotor across a narrow gap, and in which peripheral pump flow paths are provided in step-like recessions inside the stator;

a rotary shaft connected to said rotor and rotatably supported by a hydrodynamic type radial gas bearing capable of supporting loads of said shaft in a radial direction of said shaft and a grease-lubricating ball bearing; and a motor portion for operating said rotor, said motor portion being located along an axial length of said rotary shaft between said hydrodynamic type radial gas bearing and said grease-lubricating ball bearing with said radial gas bearing being located between said pumping mechanism portion of said pump and said motor portion;

wherein gas drawn in through the inlet port can be discharged into the atmosphere through the outlet port.

6. A turbo vacuum pump according to claim 5, wherein a means for cooling air is provided in the motor portion.

7. A turbo vacuum pump according to claim 5, wherein a spiral grooved pump stage is disposed on the side of an inhaling opening of a peripheral pump stage.

* * * * *